US005743406A

United States Patent [19]

Wright

[11] Patent Number: 5,743,406

[45] Date of Patent: Apr. 28, 1998

[54] NAIL POLISH BOTTLE HOLDER FOR USE IN MANICURING PANS

[76] Inventor: Bruce Anthony Wright, 138 Roy Thomason Rd., Simpsonville, S.C. 29681

[21] Appl. No.: 752,967

[22] Filed: Dec. 2, 1996

Related U.S. Application Data

[63] Continuation-in-part of Ser. No. 266,898, Jul. 1, 1994, abandoned.

[51] Int. Cl.[6] ..... B65D 1/34

[52] U.S. Cl. ..... 206/565; 206/557; 220/737

[58] Field of Search ..... 206/557, 558, 206/559, 560, 561, 562, 563, 564, 565, 566, 567; 220/737

[56] References Cited

U.S. PATENT DOCUMENTS

| | | | |
|---|---|---|---|
| 2,219,597 | 10/1940 | Lutz | 206/559 |
| 4,844,249 | 7/1989 | Coulombe | 206/562 |
| 4,877,284 | 10/1989 | Doane | 206/558 |
| 5,181,613 | 1/1993 | Wright | 206/567 |
| 5,273,160 | 12/1993 | Malvasio | 206/561 |

*Primary Examiner*—David T. Fidei
*Attorney, Agent, or Firm*—John P. Halvonik

[57] ABSTRACT

An improved pan of the kind used for supporting hands and/or feet for working on the cuticles the improvement being a support for a bottle that may hold nail polish or other material. The support is a sloping surface and a pair of VECLRO straps in connection with the inside of one of the side walls the pan. The support may have a sloped bottom surface for supporting the bottle of nail polish at an angle to that of the surface of the pan, thereby allowing the brush to dip into the bottle for maximum use of the polish. Support straps with VELCRO closures may be used to further secure the bottle to the side of the wall.

3 Claims, 2 Drawing Sheets

NAIL POLISH BOTTLE HOLDER FOR USE IN MANICURING PANS

This application is a continuation in part of U.S. Ser. No. 08/266,898, filed Jul. 1, 1994, now abandoned.

BACKGROUND OF THE INVENTION

1. Field of the Invention

The invention is an improvement on the applicant's invention the Pedi Pan the subject of U.S. Pat. No. 5,181, 613. The improvement represents the use of a supporting element on the inside of at least one of the inner walls of the inventor's pan. The support facilitates the placement of a bottle of nail polish or other such material used in nail manicuring operation) within easy reach of the person who is manicuring the nails of the hand or foot that is placed in the pan. Oftentimes nail polish or other liquid material is used in a manicuring operation. Nail polish is generally stored in small bottles with an applicator brush.

2. Description of the Prior Art

There are no known holders of nail polish for a manicuring pan.

SUMMARY OF THE INVENTION

The invention is an improved pan for supporting hands and/or feet the improvement comprising: a support apparatus to secure a nail polish bottle. The pan comprises at least three walls and at least one nail polish support in connection with at least one of the side walls. The support may have a sloped lower wall for supporting the bottle of nail polish at an angle so that the bottle leans against one of the side walls. In addition to the supporting action, the nail polish brush may be able to dip into the bottom of the bottle for maximum use of the polish. Support straps with VELCRO closures may be used to further secure the bottle to the side of the wall.

It is an object of the invention to equip a manicuring pan with a holder for a bottle of nailpolish or other materials that may be used in connection with the manicuring of the hands.

Another objective is to provide a receptacle for holding a nail polish bottle within a short distance of the foot or hand receiving a manicuring operation.

Another objective is to provide a pan for supporting a foot and/or hand and a nail polish bottle to facilitate the care and decoration of the cuticles Other objectives of the invention should be readily apparent to those skilled in the art once the invention has been described.

DESCRIPTION OF THE PREFERRED EMBODIMENT

Figure 1:
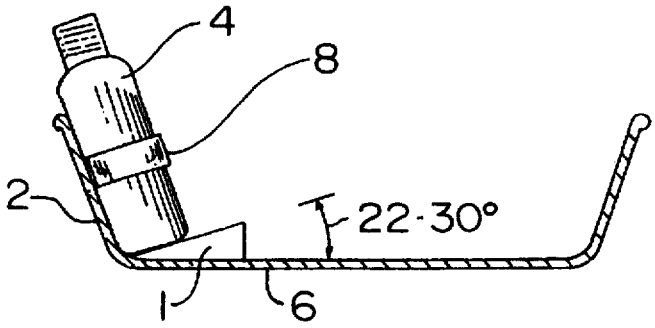
FIG. 1 Front view of pan and nail polish holder.
Figure 2:
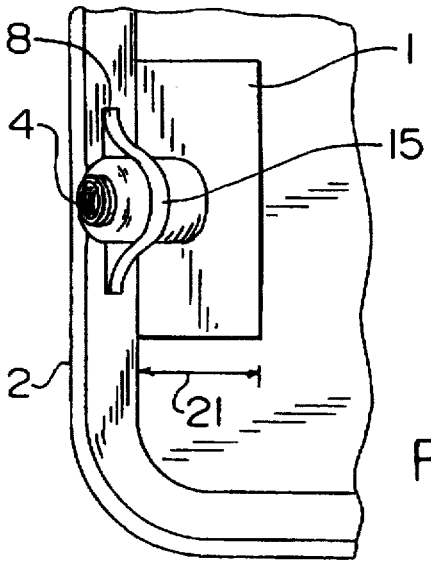
FIG. 2 Top view holder and bottle.
Figure 4:
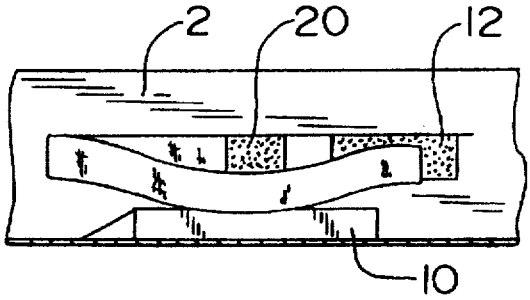
FIG. 4 Side view of wall and holder.
Figure 3:
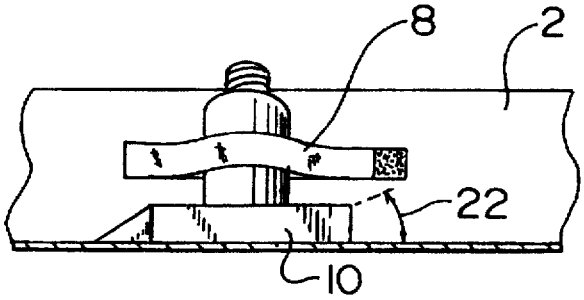
FIG. 3 Side view of holder and bottle.

The improved nail cutting receptacle with nail polish holder is shown in FIG. 1. There is a raised portion 1 which supports the nail polish bottle 4. This upraised portion should be in connection with one of the side walls 2 of the pan. This portion may have a sloping upper surface which surface slopes at an angle toward the bottom surface 6 of the pan, this angle shown in FIG. 1. This allows the bottle of nail polish to lean against the side wall as shown.

The surface should be at an angle of about 22°–30° to that of the bottom surface of the pan. It is preferred that the upraised surface should be about ⅝" in width (line 21) and about ⅛" in height (line 22). The length is preferably about 1.5".

VELCRO equipped straps or strips 8 and 12 may be used to secure the bottle to the side wall. In addition, there may be frictional portion on one of the straps at 15 and/or 20 to keep the bottle from moving. Mating patches of either hook or loop material are used on of the straps 12 and a corresponding type of material is used on the other strap 8. These straps may be of various lengths and shapes. Preferred length of strip is 6".

Figure 5:
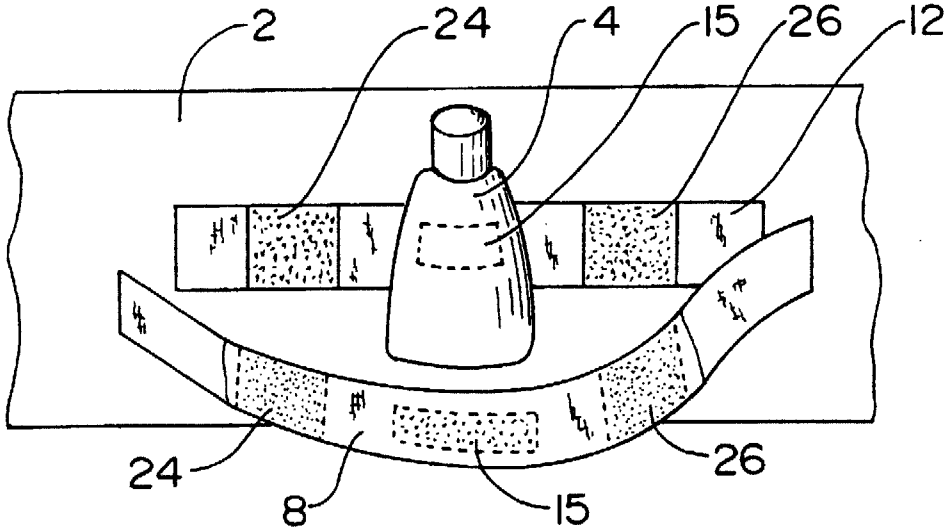
FIG. 5 View of bottle holder and straps.

VELCRO (complimentary portions of hook and loop material) portions of material should cover whole area from front portion 24 to end portions 26 of the straps 8 and 12 except at 15. The VELCRO on the inside surface of 8 may then be mated with a complimentary strip of VELCRO on the outside surface of 12 in every place except at 15, the area on both sides of the bottle, as shown in FIG. 5.

Figure 6:
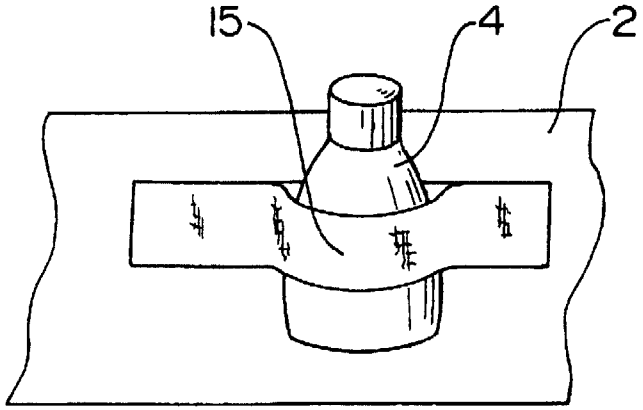
FIG. 6 View of bottle with straps attached

As both straps are secured to one another on either side of the bottle this arrangement will conform to shape of bottle for a snug fit enclosing it between those sections of the straps that form the loop, see FIG. 6. For these reasons, the securing of the bottle does not depend on friction as it is not necessary that they have to stretch around the bottle in order to secure it. Because the straps can remain attached to one another, it is not necessary to break the VELCRO attachment of the straps from one another in order to take out the existing nail polish bottle and replace it with another. One can simply remove the bottle from the "loop" formed in the straps (i.e. the area between the unmated sections of VELCRO) and then place another bottle inside the loop.

Frictional material used at 15, used on inside surface 8 and outside surface 12, is helpful only in keeping the bottle from shifting while the straps 8 and 12 are being attached to one another and around the bottle. It is preferred that the bottle lean against the side wall as shown in FIG. 1. It is preferred that the side wall be angled as seen in FIG. 1.

Of course, the support described herein may be used to hold bottles of various kinds. Many different substances may behold in bottles. It is believed that the support will find its greatest utility in supporting nail polish bottles as they are oftentimes used in manicuring operations The pedi pan may find use with feet and hands of one whose cuticles need to attending. Such work includes cutting the nails or, perhaps, a manicuring operation which includes removing layers of material from the nail and replacing with layers made by applying the nail polish.

I claim:

1. An improved foot manicure pan for holding bottles comprising: a bottom wall and at least three side walls in connection with said bottom wall so as to form a partially enclosed space, at least two of said side walls extending outwardly so as to form an angled surface with said bottom wall and so adapted to support a bottle that may be tilted against at least one of said side walls, said partially enclosed space of size adapted to enclose a human foot, at least one of said side walls having a pair of securing straps: a first inner strap in close connection with said side wall and a second outer strap about parallel to said first strap, said first strap having an outer surface facing away from said side wall and said second strap having an inner surface facing said first strap, complimentary portions of hook and loop material on said outer and said inner surfaces and sized so that said portions of hook and loop material may be mated to one another so as to form a snug fitting loop around a bottle.

2. The apparatus of claim 1 where at least one of said straps has a frictional material portion on one side of said strap so as to keep the bottle from shifting while securing it.

3. The apparatus of claim 2 wherein said straps are about 6" in length.

* * * * *